US010681456B2

(12) United States Patent
Größler et al.

(10) Patent No.: US 10,681,456 B2
(45) Date of Patent: Jun. 9, 2020

(54) BASS REFLEX TUBE FOR A LOUDSPEAKER

(71) Applicant: Burmester Audiosysteme GmbH, Berlin (DE)

(72) Inventors: Stefan Größler, Berlin (DE); Robert Horbach, Berlin (DE); Martin Lorenz, Berlin (DE); Pascal-Philippe Bings, Berlin (DE); Thomas Wenzel, Berlin (DE)

(73) Assignee: Burmester Audiosysteme GmbH, Berlin (DE)

( * ) Notice: Subject to any disclaimer, the term of this patent is extended or adjusted under 35 U.S.C. 154(b) by 0 days.

(21) Appl. No.: 16/097,350

(22) PCT Filed: Apr. 29, 2016

(86) PCT No.: PCT/EP2016/059683
§ 371 (c)(1),
(2) Date: Oct. 29, 2018

(87) PCT Pub. No.: WO2017/186311
PCT Pub. Date: Nov. 2, 2017

(65) Prior Publication Data

US 2019/0149909 A1 May 16, 2019

(51) Int. Cl.
*H04R 1/28* (2006.01)
*H04R 1/02* (2006.01)

(52) U.S. Cl.
CPC ..... *H04R 1/2826* (2013.01); *H04R 1/025* (2013.01); *H04R 1/2819* (2013.01)

(58) Field of Classification Search
CPC .... H04R 1/2826; H04R 1/025; H04R 1/2819; H04R 1/2823; H04R 1/2846; H04R 1/2807; H04R 1/2876
See application file for complete search history.

(56) References Cited

U.S. PATENT DOCUMENTS 5,109,422 A 4/1992 Furukawa
2014/0226845 A1* 8/2014 Pellisari ..... H04R 1/2826 381/353

FOREIGN PATENT DOCUMENTS

CN 1127975 A * 7/1996
CN 1127975 A 7/1996
(Continued)

OTHER PUBLICATIONS

International search report for patent application No. PCT/EP2016/059683 dated Jan. 17, 2017.
(Continued)

*Primary Examiner* — Sunita Joshi
(74) *Attorney, Agent, or Firm* — Bachman & LaPointe, PC

(57) ABSTRACT

The present invention refers to a loudspeaker, in especially to a bass reflex tube for a loudspeaker. Commonly, said loudspeakers include at least one woofer driver, by which an electric audio signal is transduced via a voice coil and a diaphragm into soundwaves of medium to low frequency. A bass reflex tube for a loudspeaker should be provided, which enables said loudspeaker to produce an acoustic signal according to an electrical signal, wherein the acoustic signal shows optimized an improved quality characteristics, in especially with regards to quality and accuracy of the conversion of electrical signal into the acoustic signal. The problem mentioned above is solved by a bass reflex tube for a loudspeaker, wherein said bass reflex tube is at least partially made of a ceramic material. Further, the bass reflex tube comprises a tubular portion, which is extending in an axial direction of a longitudinal axis of the bass reflex tube.

17 Claims, 2 Drawing Sheets

(56) References Cited

FOREIGN PATENT DOCUMENTS

| | | | | |
|---|---|---|---|---|
| CN | 1633211 | A | | 6/2005 |
| CN | 1728884 | A | | 2/2006 |
| CN | 202873014 | U | * | 4/2013 |
| DE | 20309771 | U1 | | 10/2003 |
| GB | 2523143 | A | | 8/2015 |
| JP | 62103624 | U | | 8/1977 |
| JP | 08140177 | A | | 5/1996 |
| JP | 2009094989 | A | | 4/2009 |
| JP | 2014179930 | A | | 9/2014 |
| RU | 2102839 | C1 | | 1/1998 |
| WO | 2005104607 | A1 | | 11/2005 |

OTHER PUBLICATIONS

Office action for patent application No. 10-2018-7033124 dated Aug. 28, 2019.
Japanese office action for patent application No. 2019-507993 dated Jan. 16, 2020.
Request for substantive examination for patent application No. 2018141857/28 dated Sep. 19, 2019.
Korean office action for patent application No. 10-2018-7033124 dated Mar. 24, 2020.

* cited by examiner

BASS REFLEX TUBE FOR A LOUDSPEAKER

TECHNICAL FIELD

The present invention refers to a loudspeaker, in especially to a bass reflex tube for a loudspeaker. Usually, a loudspeaker comprises a housing and at least one acoustic driver for transducing electrical signals in soundwaves, respectively in an acoustic signal. Such loudspeakers—also called loudspeaker box—are used in standard stereo equipment, mostly in a set of two for obtaining an acoustic stereo effect.

PRIOR ART

Commonly, a said loudspeakers include at least one woofer driver (bass driver), by which an electric audio signal is transduced via a voice coil and a diaphragm into soundwaves of—with respect to the human audible frequency—medium to low frequency. For obtaining high fidelity (hi-fi) reproduction of sound multiple drivers, like a tweeter driver, mid-range driver and a woofer driver, are arranged in the same housing. Each driver reproduces a part of the audible frequency range.

Furthermore, a certain type of loudspeaker comes with a bass reflex tube mounted in the housing, also known as (reflex-) port or vent. By such measure, these loudspeakers use the sound from the rear side of the diaphragm to increase the efficiency at low frequencies. Usually the bass reflex tube has a shape of a pipe or tube. When the woofer driver is active, the air mass in the bass reflex tube resonates with the air inside the housing of the loudspeaker. The resonating frequency (also called Helmholtz resonance) of such bass reflex tube system depends upon the length and cross-sectional size of the tube and up on the volume of the housing.

The international patent application WO 2005/104607 A1 discloses a loudspeaker box having a woofer driver and a bass reflex tube for emitting at least part of the acoustic pressure generated by the bass loudspeaker. Said bass reflex tube is segmented and configured by nested, closed annular walls that are mounted in opposite directions on opposite support walls of the housing and terminate at a distance to the respective other support wall, spaced apart from one another.

Disadvantages of the Prior Art

Bass reflex tubes according to the prior art and loudspeakers comprising such bass reflex tube generally come with an acoustic quality which, at least for the acoustical trained listener, could be optimized.

Problem to be Solved

Therefore, it is a task of the present invention to overcome mentioned disadvantages of current bass reflex tubes and loudspeakers comprising such bass reflex tubes. In particular, a bass reflex tube for a loudspeaker should be provided, which enables said loudspeaker to produce an acoustic signal according to an electrical signal, wherein the acoustic signal, for example music, shows optimized an improved quality characteristics, in especially with regards to an accuracy of the conversion of electrical signal into the acoustic signal.

SUMMARY OF THE INVENTION

The problem mentioned above is solved by a bass reflex tube for a loudspeaker and by a loudspeaker as disclosed herein.

According to an embodiment of the bass reflex tube, said bass reflex tube is at least partially made of a ceramic material. Regardless the fact, that a bass reflex tube (at least partially) made of the ceramic potentially may come with higher costs, it was identified—during the course of i.e. acoustic experiments—that the application of ceramic components or parts of the bass reflex tube influence the overall acoustic characteristics of the system of loudspeaker and bass reflex tube in an improving manner. In especially, it was discovered, that a behaviour with regards to reflection of soundwaves and an aerodynamic reaction of the related air flow improves remarkably. In particular, a listening person senses the soundwaves as being more precise, having well defined wave fronts, hence, the sound is experienced as being more compact, tight and/or taut. Overall, undesired noise caused by disturbance of the airflow within the bass reflex tube is reduced dramatically.

According to another embodiment of the bass reflex tube, said bass reflex tube is at least partially made of porcelain. Referring to the embodiment as described above, the ceramic material applied in the bass reflex tube is porcelain. The use of porcelain comes with improved acoustic characteristics. Despite the common prejudice against the cost of an application of porcelain, experiments revealed, that a loudspeaker having a bass reflex tube partially made of porcelain remarkably improves with regards to the characteristics mentioned.

With regards to an embodiment of the invention as described, the bass reflex tube comprises a tubular portion, which is extending in an axial direction of a longitudinal axis of the bass reflex tube. By this an inner surface is formed. An axial rear portion and an axial front portion are provided, both neighbouring the tubular portion on both sides in axial direction. Therefore, the very form of the bass reflex tube is achieved by the front portion—usually facing an outside surface of the housing of the loudspeaker—, the tubular portion and the rear portion.

It is disclosed by a further embodiment, that at least the inner surface of the tubular portion is made of a ceramic material. The usage of ceramic material on the inner surface amplifies the positive effect of the material usage mentioned above. Since the inner surface of the bass reflex tube reflects non-axial directed soundwaves, the inner surface participates in a major, relevant manner to the formation of the acoustic signal produced by the loudspeaker.

According to a further embodiment, the tubular portion is mainly made of a ceramic material. Due to the major influence on the resonance characteristics of the bass reflex tube, the positive effect mentioned above increases with a tubular portion mainly or entirely made of the ceramic material, in particular of porcelain.

Optionally, the tubular portion of the bass reflex tube can have an inner tube wall and an outer tube wall, wherein the inner tube wall and the outer tube wall are, at least partially, extending in axial direction. Generally spoken, said inner and outer tube walls are mainly directed in axial direction in order to form the tubular portion. However, said tube walls may have a shape of a curve in a longitudinal sectional view and/or are declined or inclined with respect to the longitudinal axis of the tubular portion.

According to an optional embodiment, at least the inner tube wall is made of the ceramic material; in particular the inner tube wall is made of porcelain. By applying such teaching the manufacturing process of the inner porcelain or ceramic surface is simplified.

As an optional embodiment it is proposed for cost savings, to manufacture the outer tube wall from a material other than a ceramic or porcelain material. That means, the tubular portion can partially be made of a ceramic or porcelain material in form of an inner porcelain or ceramic tube wall, wherein the use of porcelain or ceramic material is explicitly disclaimed with regards to the outer tube wall.

For obtaining additional cost benefits the inner tube wall and the outer tube wall can be arranged with respect to each other in form of an inlay-structure. Hence, the inner tube wall can be inserted during manufacturing into an inner space of the outer tube wall. Optionally, the inner tube wall can be supported by the outer tube wall, when being manufactured in such manner.

According to another embodiment the inner tube wall and the outer tube wall are arranged with respect to each other such, that a cavity is formed between the inner tube wall and the outer tube wall. By properly configuring the form and size of such cavity the vibrational characteristic of the tubular portion can be influenced.

In particular, if said inner cavity is filled with a material with defined characteristics a powerful tool for adjusting resonance characteristics of the bass reflex tube is provided. Favourably, the material is adapted for preventing and/or reducing resonance phenomena taking place at, within or in a structural context with the bass reflex tube. According to a form of the present embodiment, the cavity can be filled with a damping or insulation material.

According to a further form of the present embodiment, the cavity is filled with a foam-like material, in especially with an open-porous foam. In particular, positive effects are achieved, if the cavity is filled with aluminium foam.

The front portion of the bass reflex tube may comprise a front surface, which is at least partially extending in a radial direction with regards to the longitudinal axis of the bass reflex tube. Said front surface can be made of the ceramic or porcelain material, which leads to an improved sound in mission from the bass reflex tube. Optionally, the front portion can be made entirely from the ceramic or porcelain material.

According to another embodiment, the inner surface and/or the front surface of the bass reflex tube are polished. This measure leads to an improved reflection behaviour of soundwaves on the mentioned surfaces.

According to another embodiment, the inner surface of the tubular portion has a continuous shape. In especially, if the entire inner surface comes with such continuous shape, the acoustic, absorbing and reflecting characteristics of the surface are optimized. The term "continuous" should be understood such, that no steps or edges are present within the inner volume or on the inner surface of the bass reflex tube, which could lead to unwanted reflections of soundwaves.

Furthermore it is disclosed by an independent embodiment, that an inner diameter of the tubular portion tapers in axial direction from the front portion towards a middle section of the tubular portion. That means, the size of an opening of the front portion—if projected axially—is larger than a size of the opening of the middle section of the tubular portion. Hence, coming from the front portion, the tube walls are closing-in towards the middle section of the tubular portion.

Extending such principle, the tubular portion has a roundish, waist-like shape in a longitudinal sectional view. In axial direction, an inner diameter of a front opening of the tubular portion and an inner diameter of a rear opening of the rear portion are larger than an inner diameter of the middle section.

The emission of soundwaves is improved further, if—according to another embodiment—the inner surface of the tubular portion is merging into the front surface of the front portion, in particular in a continuous manner.

The mentioned problem is independently solved by a loudspeaker comprising a housing, at least one woofer driver and at least one bass reflex tube according to any or a plurality of the preceding embodiments or to a practical combination of the embodiments and forms thereof as mentioned above.

The embodiments as described above can be combined with each other in a practical and appropriate manner. Hence, the invention is not necessarily limited to embodiments shown above and in the following.

DESCRIPTION OF FIGURES

The attached figures display various embodiments and thereby serve in conjunction with the description for explaining the principles of the invention. Single features depicted in the figures are shown relatively with regards to each other and therefore are not necessarily to scale.

Similar or same elements in the figures, even if displayed in different embodiments, are represented with the same reference numbers.

EMBODIMENTS

Figure 1:
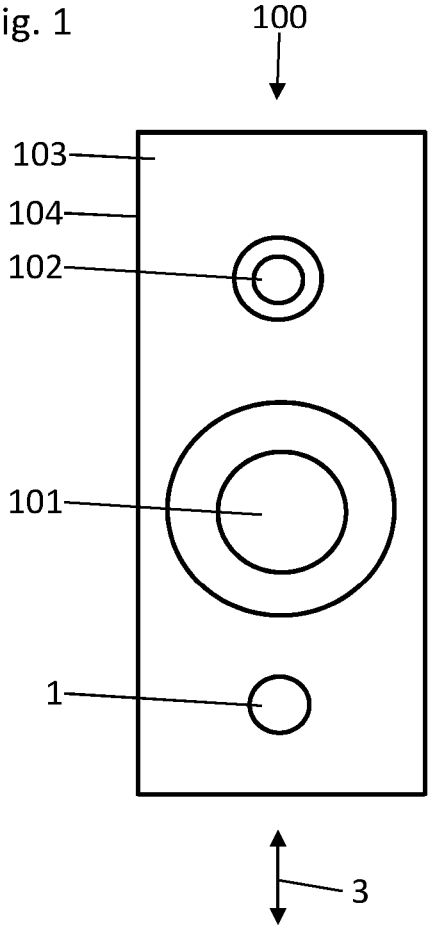
FIG. 1 shows a front view on a loudspeaker.
Figure 2:
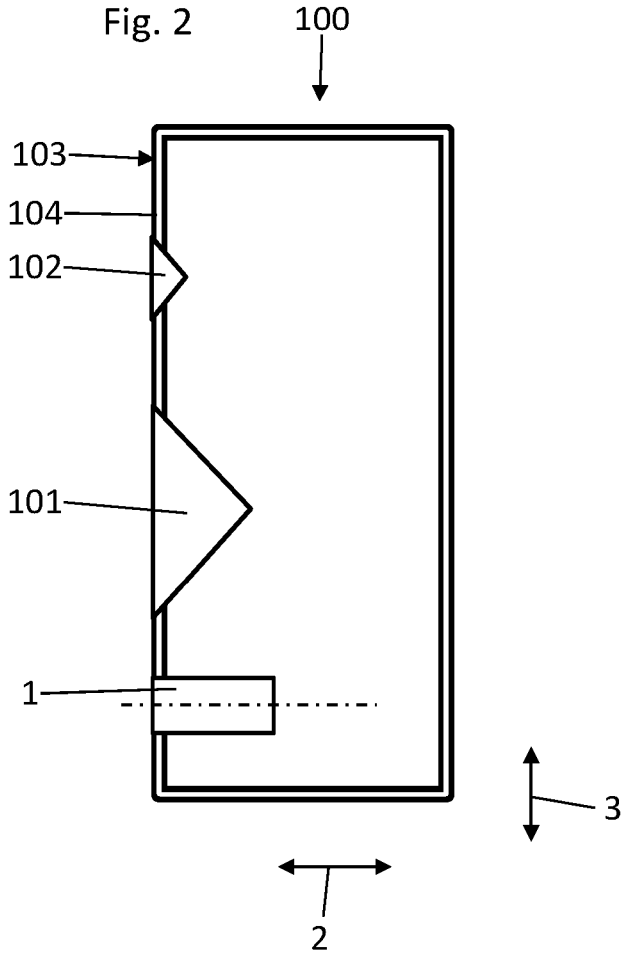
FIG. 2 depicts a side view on the loudspeaker according to FIG. 1.

FIG. 1 and FIG. 2 display a loudspeaker 100, wherein FIG. 1 is a front view and FIG. 2 is a side view. According to this exemplary embodiment, the loudspeaker 100 comprises at least a housing 103 having a housing wall 104, wherein the housing 103 forms a front side 105 for facing and auditory or a listening person. A plurality of openings is arranged within the front side 105, in which a tweeter driver 102, a woofer driver 101 and a bass reflex tube 1 are nested. A longitudinal axis 11 of bass reflex tube 1 is arranged perpendicular with regards to the front side 105, hence, a main emission direction of soundwaves being emitted through the bass reflex tube 1 is mainly perpendicular to front side 105. The described details of the embodiment of the loudspeaker 100 shall not limit the extent of the invention such, that the described arrangement is essentially required for embodying the invention. Possibly, an embodiment of a loudspeaker could also comprise more than two acoustic drivers, for example two woofer drivers, a midrange driver, one tweeter driver and two bass reflex tubes 1. Said bass reflex tubes 1 can be arranged within the front side 105, also in a backside, top or bottom of the housing walls of the loudspeaker.

Figure 3:
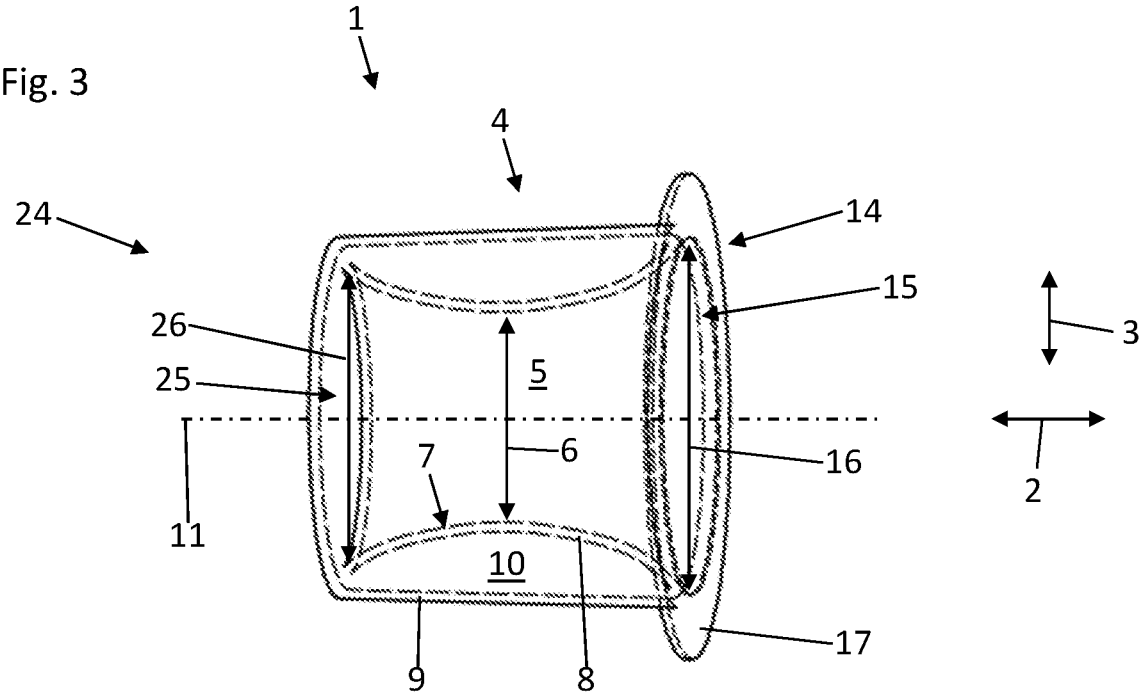
FIG. 3 is a slightly three-dimensional sectional view of the bass reflex tube being mounted in a loudspeaker according to FIG. 1 and FIG. 2.
Figure 4:
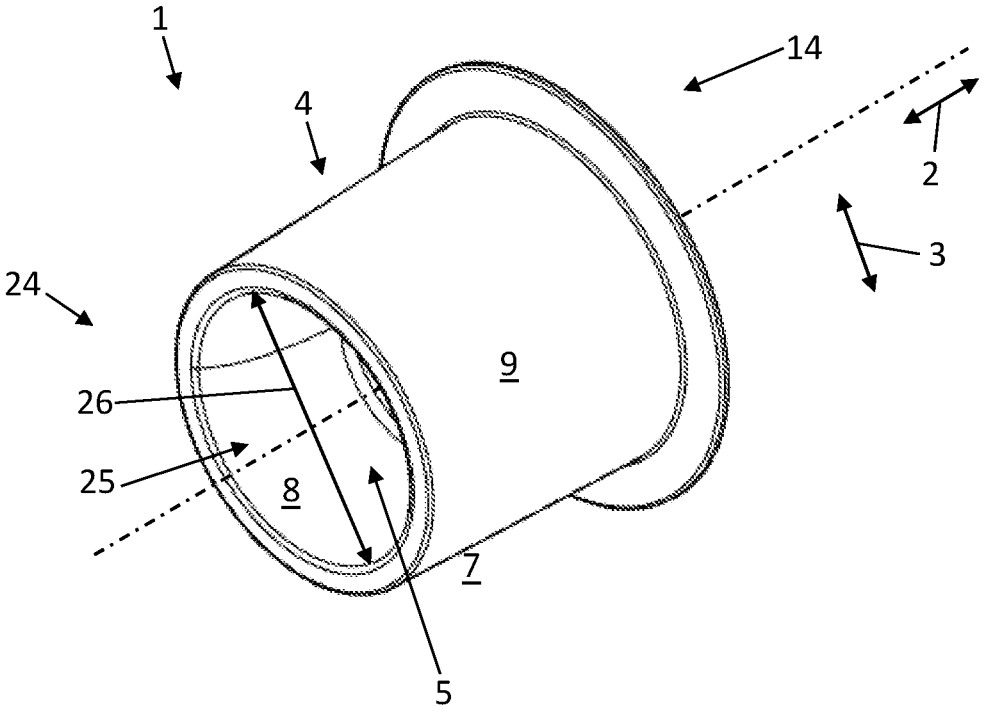
FIG. 4 is a three-dimensional view on the rear portion of the bass reflex tube according to FIG. 3.
Figure 5:
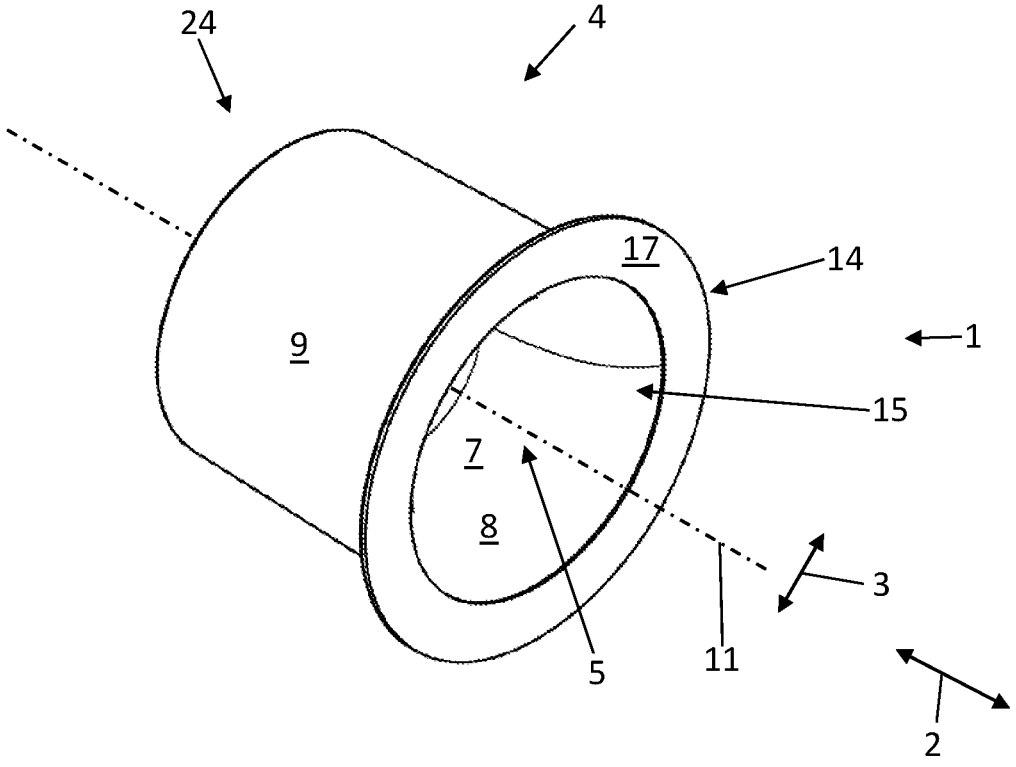
FIG. 5 is a three-dimensional view on the front portion of the bass reflex tube according to FIG. 3.

The FIGS. 3 to 5 depict a perspective view on an embodiment of the bass reflex tube 1, wherein FIG. 3 is a three-dimensional sectional view showing the geometric structure of obviously nonvisible parts of the bass reflex tube 1. Said bass reflex tube 1 has basically a tube-like form, at least partially consisting of a tubular portion 4 being axially directed with respect to the longitudinal axis 11. The tubular portion 4 is limited in axial direction 2 by the front portion 14 and the rear portion 24, wherein the front portion 14 or the rear portion 24 do not necessarily be embodied/materialized as an actual structure, but those portions 14 and 24 shall represent the physical limits of the bass reflex tube 1, respectively of the tubular portion 14. However, the described geometric structure can be chosen differently in order to work the invention. For example, the bass reflex tube can also be formed as a ring, thus having a large diameter with respect to a tubular length.

The rear portion 24 and the front portion 14, each includes an opening 24, 25 for providing an open, tubular throughwhole protruding through the tubular portion 4. When the bass reflex tube 1 is mounted to the loudspeaker 100, the rear opening 25 of the rear portion 24 enables soundwaves within the housing 103 to enter through the rear opening 25 in the tubular portion 14 and subsequently to exit the bass reflex tube 1 through the front opening 15. The tubular portion 4 comprises radially inner surface 7, which mainly extends in axial direction 2, but may also be directed, at least partially, in a radial direction 3.

The inner surface 7 of the tubular portion 4 of the bass reflex tube 1 shown in FIGS. 3 to 5 can be made of a ceramic material, in particular of porcelain. Said measure comes with the effect, that soundwaves traveling through the tubular portion 4 are influenced favorably by the porcelain surface 7, which results in an improved acoustic sensation being experienced by a listening person in the surroundings of the loudspeaker 100.

The front portion 14 may have a front surface 17 at least partially extending in a radial direction 2. In particular, the front portion 14 may be designed such, that—when the bass reflex tube 1 is mounted to the loudspeaker 100—the front surface 17 is arranged collar-wise on the front side 105 of the loudspeaker 100. According to an embodiment, the front surface 17 of the front portion 14 is made of a ceramic material, in particular of porcelain. Due to the fact, that the front surface 17 also participates in channelling and influencing soundwaves traveling through the tubular portion 4, the described application of a ceramic material or porcelain for said front surface 17 provides an enhancement of the acoustic characteristics of the loudspeaker 100 having the bass reflex tube 1.

According to the embodiment of the bass reflex tube 1 shown in FIG. 3—but not limited to it —, the tubular portion 4 has an inner wall 8 and an outer wall 9, thereby forming a cavity 10 in between the inner wall 8 and the outer wall 9. The inner wall 8 is designed with a convex shape with respect to the longitudinal axis 11. Thus, the inner volume of the tubular portion 4 comprises waist-like shape, wherein a middle section 5 of the tubular portion 4 has an inner diameter 6, which is smaller than an inner diameter 26 of the rear opening 25 and which is smaller than an inner diameter 16 of the front opening 15, too. However, the cavity can also be provided by an inner wall and outer wall, which have a different shape as described, for example, the cavity 10 can be formed by two straight walls, which are arranged with a radial distance with respect to each other.

An embodiment of the shown bass reflex tube 1 can be made entirely of the ceramic material, in especially of porcelain. This measure could provide the positive effect, that the manufacturing process is simplified.

The present invention is not limited to the above-described embodiments and modifications and may be embodied in various forms within the gist thereof. For example, the technical features of the embodiments and modifications corresponding to the technical features according to the embodiments and forms described in the Summary of the Invention section may be replaced or combined as appropriate to solve some or all of the above-described problems or obtain some or all of the above-described effects. The technical features may also be omitted as appropriate unless they are described as being essential in this specification.

REFERENCE NUMBERS

1 bass reflex tube
2 axial direction
3 radial direction
4 tubular portion
5 middle section
6 inner diameter of the middle section
7 radial inner surface
8 inner tube wall
9 outer tube wall
10 cavity
11 longitudinal axis
14 front portion
15 front opening
16 inner diameter of the front opening
17 front surface
24 rear portion
25 rear opening
26 inner diameter of the rear opening
100 loudspeaker
101 woofer driver
102 tweeter driver
103 housing
104 housing wall
105 front side

The invention claimed is:

1. Bass reflex tube (1) for a loudspeaker (100), wherein the bass reflex tube (1) is at least partially made of a ceramic material, wherein the base reflex tube (1) comprises a tubular portion (4) extending in an axial direction (2) and thereby forming a radial inner surface (7), an axial front portion (14), and an axial rear portion (24), wherein the tubular portion (4) has an inner tube wall (8) and an outer tube wall (9), wherein the inner tube wall (8) and the outer tube wall (9) are at least partially extending in the axial direction (2), and wherein at least the inner tube wall (8) and the inner surface (7) are made of the ceramic material, wherein the inner surface (7) has a continuous shape, and wherein an inner diameter of the tubular portion (4) at least partially tapers in the axial direction (2) from the front portion (14) towards an axial middle section (5) of the tubular portion (4).

2. Bass reflex tube (1) according to claim 1, wherein the ceramic material is porcelain.

3. Bass reflex tube (1) according to claim 1, wherein the tubular portion (4) mainly is made of the ceramic material.

4. Bass reflex tube (1) according to claim 1, wherein the bass reflex tube (1) is entirely made of porcelain.

5. Bass reflex tube (1) according to claim 1, wherein the outer tube wall (9) is made from a material other than a ceramic material.

6. Bass reflex tube (1) according to claim 1, wherein the inner tube wall (8) and the outer tube wall (9) are arranged with respect to each other in form of an inlay-structure such, that the inner tube wall (8) can be inserted into the outer tube wall (9) and is supported by the outer wall (9) thereby.

7. Bass reflex tube (1) according to claim 1, wherein a cavity (10) is formed between the inner tube wall (8) and the outer tube wall (9).

8. Bass reflex tube (1) according to claim 7, wherein the cavity (10) is filled with a material adapted for preventing and/or reducing resonance phenomena taking place at, within or in a structural context with the bass reflex tube (1), in particular the cavity (10) is filled with a damping or insulation material.

9. Bass reflex tube (1) according to claim 7, wherein the cavity (10) is filled with a foam-like material.

10. Bass reflex tube (1) according to claim 7, wherein the cavity (10) is filled up with aluminium foam.

11. Bass reflex tube (1) for a loudspeaker (100), wherein the bass reflex tube (1) is at least partially made of a ceramic material, wherein the base reflex tube (1) comprises a tubular portion (4) extending in an axial direction (2) and thereby forming a radial inner surface (7), an axial front portion (14), and an axial rear portion (24), wherein the tubular portion (4) has an inner tube wall (8) and an outer tube wall (9), wherein the inner tube wall (8) and the outer tube wall (9) are at least partially extending in the axial direction (2), and wherein at least the inner tube wall (8) and the inner surface (7) are made of the ceramic material, wherein the front portion (14) comprises a front surface (17) at least partially extending in a radial direction (3), and wherein the front surface (17) is made of the ceramic material.

12. Bass reflex tube (1) according to claim 1, wherein the front portion (14) is made entirely of the ceramic material.

13. Bass reflex tube (1) according to claim 1, wherein the inner surface (7) and/or the front surface (17) is/are polished.

14. Bass reflex tube (1) according to claim 1, wherein the tubular portion (4), with regards to a sectional view in axial direction (2), has a roundish, waist-like shape, wherein an inner diameter (16) of a front opening (15) of the tubular portion (4) and an inner diameter (26) of a rear opening (25) of the rear portion (24) are larger than an inner diameter (6) of the middle section (5).

15. Bass reflex tube (1) for a loudspeaker (100), wherein the bass reflex tube (1) is at least partially made of a ceramic material, wherein the base reflex tube (1) comprises a tubular portion (4) extending in an axial direction (2) and thereby forming a radial inner surface (7), an axial front portion (14), and an axial rear portion (24), wherein the tubular portion (4) has an inner tube wall (8) and an outer tube wall (9), wherein the inner tube wall (8) and the outer tube wall (9) are at least partially extending in the axial direction (2), and wherein at least the inner tube wall (8) and the inner surface (7) are made of the ceramic material, wherein the inner surface (7) and the front surface (17) are continuously merging into each other.

16. Loudspeaker (100) comprising a housing (103), at least one woofer driver (101), and a bass reflex tube (1) according to claim 1, wherein the woofer driver (101) and the bass reflex tube (1) are mounted within a housing wall (104) and thereby projecting the housing wall (104).

17. Bass reflex tube according to claim 1, wherein no steps or edges are present in the inner surface (7).

* * * * *